US005151674A

United States Patent [19]

Flohr

[11] Patent Number: 5,151,674

[45] Date of Patent: Sep. 29, 1992

[54] POWER CIRCUIT BREAKER

[75] Inventor: Peter Flohr, Messkirch, Fed. Rep. of Germany

[73] Assignee: Heinrich Kopp GmbH & Co. KG, Kahl, Fed. Rep. of Germany

[21] Appl. No.: 646,771

[22] PCT Filed: May 2, 1990

[86] PCT No.: PCT/DE90/00316

§ 371 Date: Mar. 8, 1991

§ 102(e) Date: Mar. 8, 1991

[87] PCT Pub. No.: WO90/13903

PCT Pub. Date: Nov. 15, 1990

[30] Foreign Application Priority Data

May 9, 1989 [DE] Fed. Rep. of Germany ..... 3915127

[51] Int. Cl.[5] ..... H01H 75/00

[52] U.S. Cl. ..... 335/16; 335/195; 202/144 R; 202/147 R

[58] Field of Search ..... 335/16, 147, 195; 700/144 R, 147 R

[56] References Cited

U.S. PATENT DOCUMENTS 4,001,743 1/1977 Arnhold ..... 335/201
4,636,760 1/1987 Lee ..... 335/174
4,725,799 2/1988 Bratkowski et al. ..... 335/16

FOREIGN PATENT DOCUMENTS 3915127 9/1990 Fed. Rep. of Germany .

*Primary Examiner*—Lincoln Donovan
*Attorney, Agent, or Firm*—Horst M. Kasper

[57] ABSTRACT

An automatic cutout or a power circuit breaker with high current-limiting capacity contains no conductor connections of any kind, has only two weld or solder joints and requires no adjustment. This automatic cutout can be assembled progressively and purely mechanically from a minimum number of piece parts, without inconvenient connecting wires and without additional adjustment. Welding is prevented because the spark is discharge swiftly at the contacts and pressure of the movable contact in its bearing is guaranteed. As flexible connecting wires are dispensed with, fewer movable parts are necessary, and hence contact opening is more rapid. The excess-current trigger or the overcurrent trip is already calibrated and therefore the protective switch requires no adjustment. The excess-current trigger remains calibrated even after numerous disconnections.

20 Claims, 2 Drawing Sheets

POWER CIRCUIT BREAKER

The invention relates to a power circuit breaker according to the preamble of claim 1. Such a power circuit breaker has the object to shorten the interruption of current in case of a circuit-breaking caused by a short circuit or by an overload of the line, and to limit the current to a minimum in case of a short circuit, such that the line to be protected does not become damaged in case of a failure. Such power circuit breakers are produced today in large quantities and in part fully-automatic. Decisive for an economic success of such a production line product is the number of required individual parts necessary for the functioning of the power circuit breaker as well as the ease of assembly of these individual parts. In particular, the adjustment expenditure for the calibration of the overcurrent trip, and the connections, performed as welds or soldering joints, of the individual components passed by the current delay the production procedure.

In the course of time, the reconstruction principle of single interruption has prevailed in the development of power circuit breakers. The movable parts, such as contacts, bimetals, etc., are connected with flexible copper strands in such arrangements in order to allow the current flow. The most advanced constructions use in such a case one single stranded wire, which connects the movable contact with the free end of the bimetal, such as taught, for example, in German Patent PS-2,504,954, German Patent PS-2,841,004, and German Patent DE-3,619,239. If the operating current is now fed over the bearing point of the movable contact, as proposed in German Patent DE-3,803,849, then it can occur in this strand-free construction that fluctuating press-on forces prevail in the bearing point because of the current forces acting on the movable contact, which favor welding of the two parts. This is undesirable.

Consequently, it is an object of the invention to produce a strong, current-limiting power circuit breaker of the kind initially recited, where any strand connection can be dispensed with, and which requires only two welds or soldering joints and does not require any adjustment expenditures.

This object is achieved according to the invention by the characterizing the features of the claims.

It is achieved in an advantageous way with this arrangement that a strong, current-limiting power circuit breaker can be fully mechanically mounted with a minimum of individual parts, without interfering connection strands, and without additional adjustment expenditures. In this case, the current feed is used in the contact region, in addition to the press-on force of the contact spring, to press the movable contact into its bearing position on the sliding rail. In this way, a safe contact-making is achieved also in case of large operating currents or overcurrents. A welding of the movable contact in its current-passing bearing position is safely avoided. The current passage in the contact region is used also based on its U-shaped course, to drive the arc, generated upon switching off, by way of a blow-out effect quickly away from the contact zone into the arc-quenching and arc-extinguishing chamber. On the other hand, based on the opposite current direction, the current guiding in the arc deflector and in the movable contact is used to deflect and to throw the movable contact away from the arc deflector guide sheet and from the solid contact independent of the magnet release in case of a short circuit. The arm distance of the U-shaped blow-out loupe is retained during the switching-off such that, in contrast to conventional constructions, the arc drive does not decrease. At the same time, the counter torque of the contact spring becomes smaller based on the rotation of the movable contact. These steps lead together to a very quick course of the arc from the contact position in case of a simultaneously assured press-on pressure of the movable contact in its bearing position effect, such that a welding is avoided. Based on the elimination of the flexible connection strands, the mass of the movable parts becomes additionally smaller and consequently there occurs a quicker opening of the contact. It has been shown that an insulating web, disposed between the movable contact and the fixed contact, favorably influences the arc course, in particular, if the insulating web is comprised of a gas-generating plastic. Advantageously, an arrangement of the kind described in the German Printed Patent Publication DE-3,637,275 is selected as an overcurrent release. The advantage resides in that the overcurrent trip is already calibrated and thus an adjustment in the power circuit breaker itself can be dispensed with.

The invention is illustrated and explained in more detail based on the drawing by way of an embodiment.

BRIEF DESCRIPTION OF THE DRAWINGS

The illustration shows schematically a power circuit breaker with an arc-extingushing device, a switching mechanism, and an overcurrent trip. Arc-extingushing plates 2, a contact arrangement 3, 4, and arc deflectors 5, 6 are disposed in the arc chamber 1 parallel to the chamber floor wall. The arc deflector 6, at which the fixed contact piece 3 is attached, is connected on the one hand to the coil of the overcurrent trip 7 via the welding spot 8. The coil itself is connected with its second end via the welding spot 9 to a connection terminal 10. The arc deflector 5 forms the flank of the lower arc-extinguishing plate of the arc-extinguishing plate stack and forms with the rearward extension **5*a* the bearing position 11 for the movable contact 4. The arc deflector 5 exhibits an extension 5*b* disposed perpendicular to and in front of the arc-extinguishing plates. This extension 5*b* carries the connection terminal 12. The contact spring 13 is supported with its one end at the casing 14 and presses the movable contact 4, in a switched-on state, to the fixed contact 3. FIG. 1 illustrates this state as well as the force acting in the arrow direction on the bearing position and generated by the current flow. The switching mechanism 15 is illustrated only for a better understanding, but the switching mechanism 15** is without meaning for the short-circuit switch-off.

FIG. 2 illustrates the switched-off state with an insulating web 16 between a movable contact and a fixed contact. In this position, the extinguishing process is already terminated. The movable contact 4 is maintained in the open switching position by the switching mechanism 15.

Figure 1:
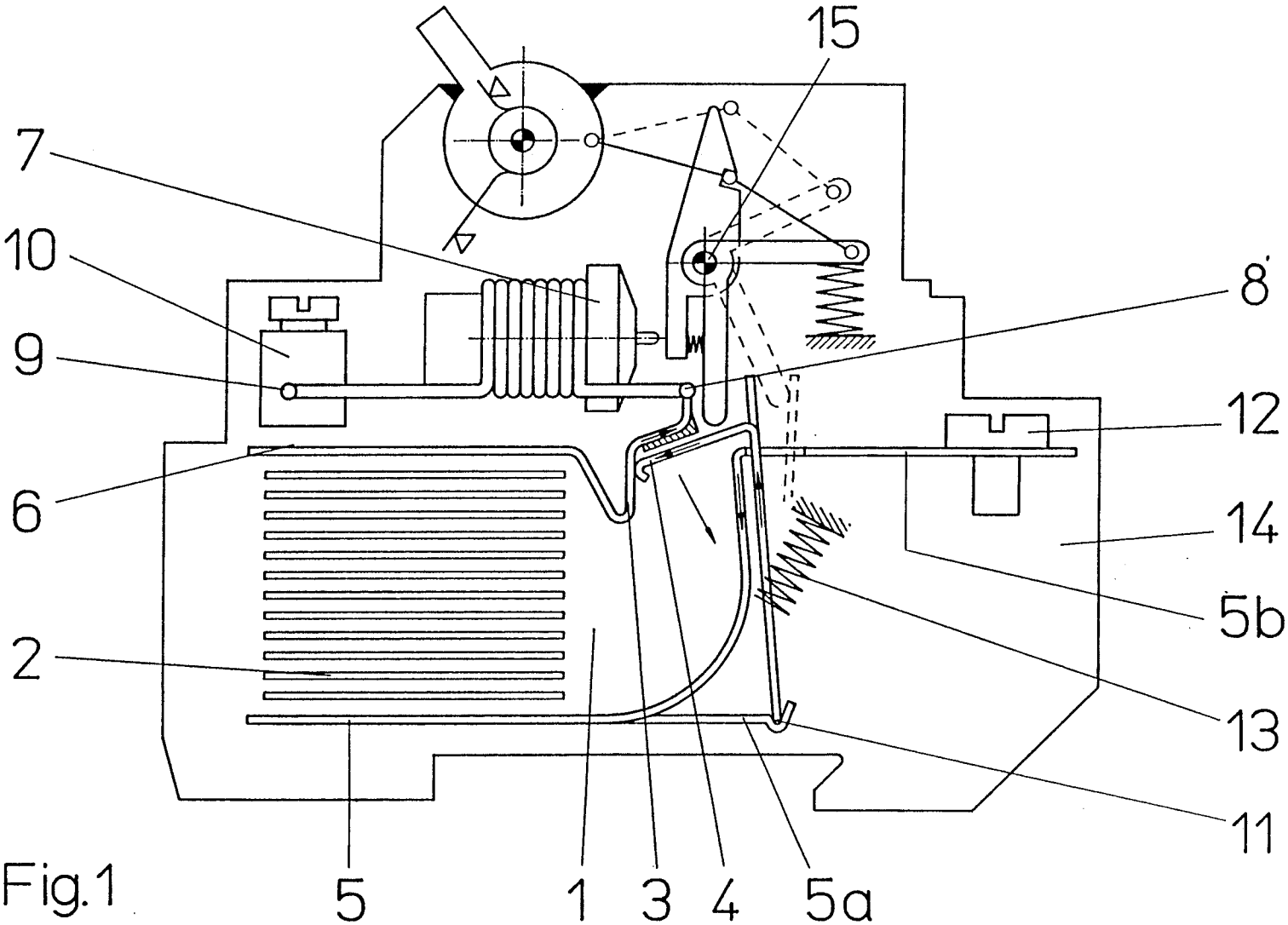
FIG. 1 shows the circuit breaker in an operating state.
Figure 2:
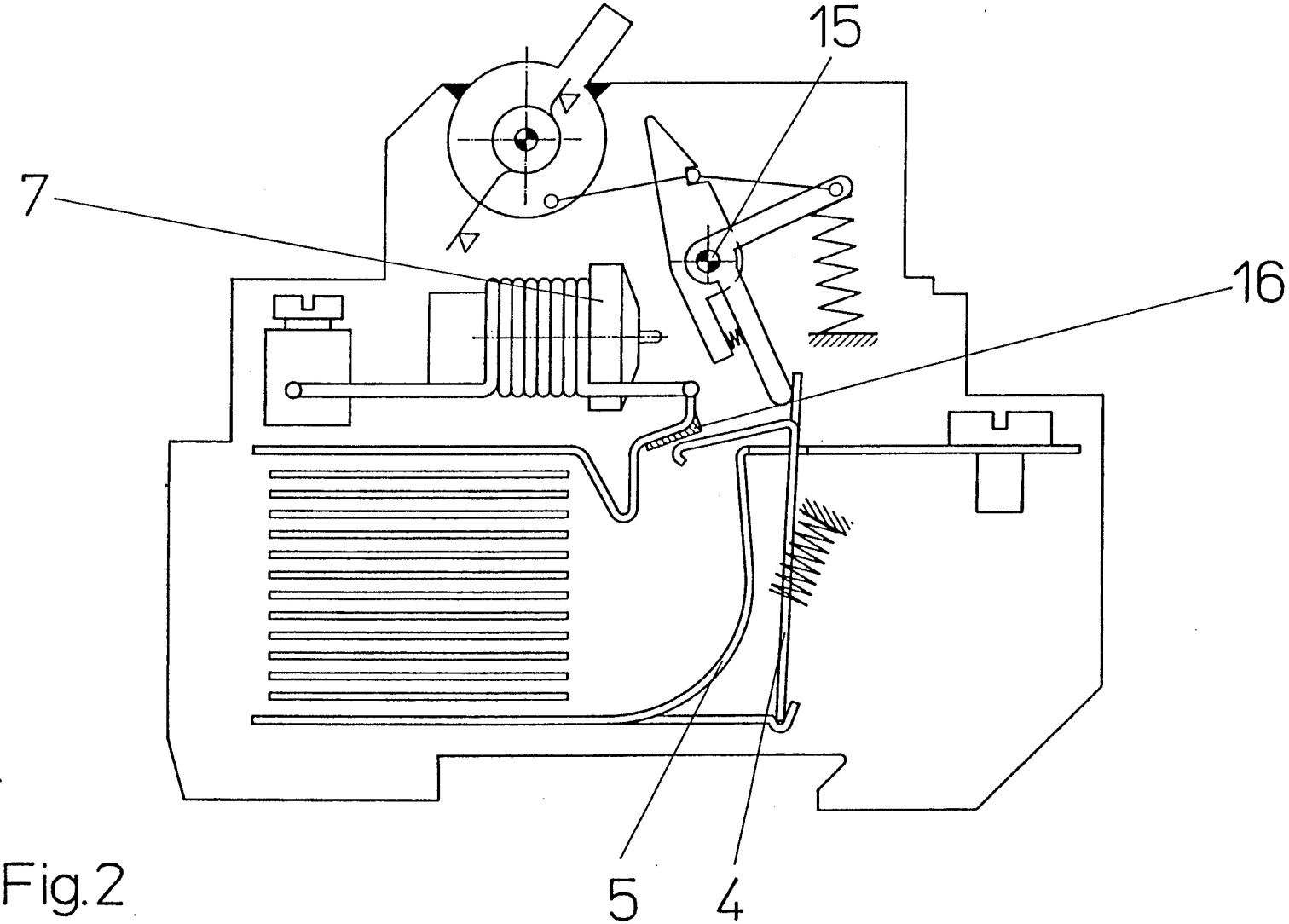
FIG. 2 shows the circuit breaker in a tripped state.

In case of closed contacts, the current flows, as shown by the arrows in the drawing, from the connection terminal 12 via the arc deflector 5 and the bearing position 11, the movable contact 4 to the fixed contact 3 and from there via the coil of the overcurrent trip 7 to the connection terminal 10. Upon occurrence of a short circuit, the movable contact 4 is thrown away from the fixed contact 3 and the current is interrupted. The movable contact 4 assumes the position indicated in FIG. 2, wherein the arc, drawn between the movable contact and the fixed contact, jumps from the movable contact to the arc deflector 5 after reaching the open position. Based on the blow-out effect of the current feed lines, the arc is driven into arc-extinguishing plate stack and is brought to extinction there.

I claim:

1. A power circuit breaker with one single interruption and electromagnetic, electrothermal and manual trip with contact arrangement disposed in the front of an arc-extinguishing plate stack in an arc chamber, wherein a first and a second arc deflector, delimiting the arc-extinguishing plate stack, as in each case galvanically connected to a connection terminal, and wherein the first arc deflector is formed as a fixed contact, and wherein the second arc deflector serves as a bearing position for a movable contact and is galvanically connected to the movable contact, wherein the movable contact (4) is canted and angled at its free end up to a contacting position such that this free end, together with the first arc deflector (6), used as a fixed contact (3), runs nearly parallel, and wherein the angled free end of the movable contact forms the tangent to a circle, and wherein the center of this circle is disposed in the neighborhood of the bearing position (11) of the movable contact (4), such that the current forces, occurring in the parallel arms increase the pressure at the bearing position as well as effect a torque in opening direction onto the movable contact.

2. The power circuit breaker according to claim 1, wherein the arc deflector (6), used as a fixed contact (3), is constructed such that it forms an obtuse angle in the region of the current feed to a contact position with a contacting face, such that a U-shaped course for the current flow results together with the free end of the movable contact (4), and wherein the axis of the U-shaped course runs nearly parallel to an attachment face of the power circuit breaker or, respectively, to the arc-extinguishing plates (2) of the power circuit breaker.

3. The power circuit breaker according to claim 1, wherein the arc deflector (5), formed as a bearing position for the movable contact (4), is disposed immediately neighboring and in parallel to the movable contact such that the repulsing current forces generate a torque acting on the movable contact in the contact opening direction.

4. The power circuit breaker according to claim 3, wherein the parallel arms of the arc deflector (3) and of the movable contact (4) are disposed nearly perpendicular to the arc-extinguishing plates and to the attachment plane of the power circuit breaker, and run in a direction toward the bearing position (11).

5. The power circuit breaker according to claim 1, wherein the movable contact (4) is rotatably supported in the bearing position (11) on the side of the arc deflector (5), disposed remote relative to the arc-extinguishing plate stack such that this bearing position is not contacted by the arc base.

6. The power circuit breaker according to claim 1, wherein the movable contact (4) is pressed to the fixed contact (3) by a contacting spring (13) in the switch-on position, wherein the effective force direction of the contact spring (13), passing close by the bearing position (11), presses the movable contact (4) additionally into the bearing position (11), and wherein the contacting spring (13) is supported in the casing (14), and wherein the movable contact does not have any mechanical connection to the switching mechanism (15).

7. The power circuit breaker according to claim 1, wherein no flexible strands are required for conducting the current, and wherein only two connection positions (8, 9) are required as welds or soldering joints.

8. The power circuit breaker according to claim 1, wherein the electromagnetic and electrothermal trip is effected with an overcurrent trip (7), wherein the current in the coil of a magnetic trip heats a bimetal snap disk as thermal trip.

9. A power circuit breaker with one single interruption and electromagnetic, electrothermal and manual trip with contact arrangement disposed in the front of an arc-extinguishing plate stack in an arc chamber, wherein a first and a second arc deflector, delimiting the arc-extinguishing plate stack, are in each case galvanically connected to a connection terminal, and wherein the first arc deflector is formed as a fixed contact, and wherein the second arc deflector serves as a bearing position for a movable contact and is galvanically connected to the movable contact, wherein the movable contact (4) is canted and angled at its free end up to a contacting position such that this free end, together with the first arc deflector (6), used as a fixed contact (3), runs nearly parallel, and wherein the angled free end of the movable contact forms the tangent to a circle, and wherein the center of this circle is disposed in the neighborhood of the bearing position (11) of the movable contact (4), such that the current forces, occurring in the parallel arms increase the pressure at the bearing position as well as effect a torque in opening direction onto the movable contact, wherein the arc deflector (6), used as a fixed contact (3), is constructed such that it forms an obtuse angle in the region of the current feed to a contact position with a contacting face, such that a U-shaped course for the current flow results together with the free end of the movable contact (4), and wherein the axis of the U-shaped course runs nearly parallel to an attachment face of the power circuit breaker or, respectively, to the arc-extinguishing plates (2) of the power circuit breaker, wherein the arc deflector (5), formed as a bearing position for the movable contact (4), is disposed immediately neighboring and in parallel to the movable contact such that the repulsing current forces generate a torque acting on the movable contact in the contact opening direction.

10. The power circuit breaker according to claim 3, wherein the parallel arms of the arc deflector (5) and of the movable contact (4) are disposed nearly perpendicular to the arc-extinguishing plates and to the attachment plane of the power circuit breaker, and run in a direction toward the bearing position (11).

11. The power circuit breaker according to claim 3, wherein the movable contact (4) is rotatably supported in the bearing position (11) on the side of the arc deflector (5), disposed remote relative to the arc-extinguishing plate stack such that this bearing position is not contacted by the arc base.

12. The power circuit breaker according to claim 3, wherein the movable contact (4) is pressed to the fixed contact (3) by a contacting spring (13) in the switch-on position, wherein the effective force direction of the contact spring (13), passing close by the bearing position (11), presses the movable contact (4) additionally into the bearing position (11), and wherein the contacting spring (13) is supported in the casing (14), and wherein the movable contact does not have any mechanical connection to the switching mechanism (15).

13. The power circuit breaker according to claim 3, wherein no flexible strands are required for conducting the current, and wherein only two connection positions (8, 9) are required as welds or soldering joints.

14. The power circuit breaker according to claim 9, wherein the electromagnetic and electrothermal trip is effected with an overcurrent trip (7), wherein the current in the coil of a magnetic trip heats a bimetal snap disk as a thermal trip.

15. The power circuit breaker according to claim 9, wherein the parallel arms of the arc deflector (5) and of the movable contact (4) are disposed nearly perpendicular to the arc-extinguishing plates and to the attachment plane of the power circuit breaker, and run in a direction toward the bearing position (11).

16. The power circuit breaker according to claim 9, wherein the movable contact (4) is rotatably supported in the bearing position (11) on the side of the arc deflector (5), disposed remote relative to the arc-extinguishing plate stack such that this bearing position is not contacted by the arc base.

17. The power circuit breaker according to claim 9, wherein the movable contact (4) is pressed to the fixed contact (3) by a contacting spring (13) in the switch-on position, wherein the effective force direction of the contact spring (13), passing close by the bearing position (11), presses the movable contact (4) additionally into the bearing position (11), and wherein the contacting spring (13) is supported in the casing (14), and wherein the movable contact does not have any mechanical connection to the switching mechanism (15).

18. The power circuit breaker according to claim 9, wherein no flexible strands are required for conducting the current, and wherein only two connection positions (8, 9) are required as welds or soldering joints.

19. The power circuit breaker according to claim 9, wherein the electromagnetic and electrothermal trip is effected with an overcurrent trip (7), wherein the current in the coil of a magnetic trip heats a bimetal snap disk as thermal trip.

20. The power circuit breaker according to claim 4, wherein the movable contact (4) is rotatably supported in the bearing position (11) on the side of the arc deflector (5), disposed remote relative to the arc-extinguishing plate stack such that this bearing position is not contacted by the arc base.

* * * * *